US010125925B2

(12) United States Patent
Chami et al.

(10) Patent No.: US 10,125,925 B2
(45) Date of Patent: Nov. 13, 2018

(54) SOLID STATE HID CANOPY LIGHT FIXTURE RETROFIT ASSEMBLY

(71) Applicant: MaxLite, Inc., West Caldwell, NJ (US)

(72) Inventors: Aymen Chami, Hackettstown, NJ (US); Amro El-Adle, Granby, MA (US)

(73) Assignee: MAXLITE, INC., West Caldwell, NJ (US)

( * ) Notice: Subject to any disclaimer, the term of this patent is extended or adjusted under 35 U.S.C. 154(b) by 0 days.

(21) Appl. No.: 15/626,346

(22) Filed: Jun. 19, 2017

(65) Prior Publication Data

US 2017/0370530 A1 Dec. 28, 2017

Related U.S. Application Data

(60) Provisional application No. 62/353,932, filed on Jun. 23, 2016.

(51) Int. Cl.

| | |
|---|---|
| ***F21V 21/00*** | (2006.01) |
| ***F21K 9/235*** | (2016.01) |
| ***F21V 23/00*** | (2015.01) |

(52) U.S. Cl.

CPC ..... *F21K 9/235* (2016.08); *F21V 23/002* (2013.01); *F21V 23/003* (2013.01)

(58) Field of Classification Search

CPC ..... F21K 9/235; F21V 23/002; F21V 23/003
See application file for complete search history.

(56) References Cited

U.S. PATENT DOCUMENTS

| | | | | |
|---|---|---|---|---|
| 7,988,335 | B2 * | 8/2011 | Liu | F21S 8/04 362/294 |
| 8,240,875 | B2 * | 8/2012 | Roberts | F21V 5/002 362/217.05 |
| 9,803,841 | B2 * | 10/2017 | Wang | F21V 19/06 |
| 9,976,732 | B2 * | 5/2018 | Myers | F21V 23/02 |
| 2014/0071687 | A1 * | 3/2014 | Tickner | F21V 21/03 362/294 |
| 2015/0319828 | A1 * | 11/2015 | Moon | H05B 33/0803 315/158 |
| 2018/0066832 | A1 * | 3/2018 | Wang | F21V 23/006 |

* cited by examiner

*Primary Examiner* — Ali Alavi
(74) *Attorney, Agent, or Firm* — Budzyn IP Law, LLC

(57) ABSTRACT

In a first aspect of the subject invention, a solid state HID canopy light fixture retrofit assembly is provided which includes: an inner panel; and, a plurality of edge members perimetrically bounding the inner panel. Each of the edge members includes: a first edge panel secured to the inner panel; a downwardly angled second edge panel depending from the first panel; and, a flange extending from the second edge panel. The first and second edge panels are each sized sufficiently to support thereon at least one board containing a plurality of solid state light generating elements. The inner panel and the edge members collectively define a contained volume sized to accommodate at least one driver for electrically powering the solid state light generating elements. The subject invention provides an assembly which is readily useable to retrofit HID canopy light fixtures from ballasted HID lighting to non-ballasted solid state lighting.

10 Claims, 4 Drawing Sheets

SOLID STATE HID CANOPY LIGHT FIXTURE RETROFIT ASSEMBLY

BACKGROUND OF THE INVENTION

High-intensity discharge lamp (HID) light fixtures in canopy form are well known in the prior art. These canopy light fixtures are horizontally mounted, typically ceiling mounted, to have downward light throw. As such, these light fixtures are well-suited for area lighting and safety lighting, for example, in parking structures, gas stations, buildings, walkways and entryways.

HID canopy light fixtures are sufficiently commonplace that a general profile size, even as amongst different manufacturers, has been adopted. A standard HID canopy light fixture has a housing, typically metallic (such as aluminum), to which is mounted a domed plastic lens (typically, acrylic). The housing of a standard HID canopy light fixture, at its opening for lens mounting, is generally square, typically with a 12"×12" profile.

HID lamps can be of various forms, but most commonly metal-halide (MEI) lamps are used in HID canopy light fixtures. HID lamps, including MH, require ballasting, which is provided in the housing of the light fixture.

Retrofitting of HID canopy light fixtures is known in the prior art with techniques requiring the mounting of a driver within the light fixture housing and separately mounting a light emitting diode (LED) structure to the housing. Placement of the driver within existing components in the housing presents difficulties.

SUMMARY OF THE INVENTION

In a first aspect of the subject invention, a solid state HID canopy light fixture retrofit assembly is provided which includes: an inner panel; and, a plurality of edge members perimetrically bounding the inner panel. Each of the edge members includes: a first edge panel secured to the inner panel; a downwardly angled second edge panel depending from the first panel; and, a flange extending from the second edge panel. The first and second edge panels are each sized sufficiently to support thereon at least one board containing a plurality of solid state light generating elements. The inner panel and the edge members collectively define a contained volume sized to accommodate at least one driver for electrically powering the solid state light generating elements. Advantageously, the subject invention provides an assembly which is readily useable to retrofit HID canopy light fixtures from ballasted HID lighting to non-ballasted solid state lighting.

In a further aspect of the subject invention, a solid state HID canopy light retrofit assembly is provided which includes: an inner panel; and, a plurality of edge members perimetrically bounding the inner panel. Each of the edge members includes: a first edge panel secured to the inner panel; a downwardly angled second edge panel depending from the first panel; and, a flange extending from the second edge panel. At least one wiring hole is provided in each of the first and second edge panels. A plurality of boards, each containing a plurality of solid state light generating elements, is mounted to one or more of the first edge panels and the second edge panels. At least one driver is secured to the inner panel, the at least one driver configured to receive alternating current electrical power and to transmit direct current electrical power for electrically powering the solid state light generating elements, with a plurality of electrical supply wires being provided for electrically conveying the direct current electrical power from the at least one driver to the boards via the corresponding wire holes.

These and other features of the subject invention will be better understood through a study of the following detailed description and accompanying drawings.

DETAILED DESCRIPTION OF THE INVENTION

Figure 1:
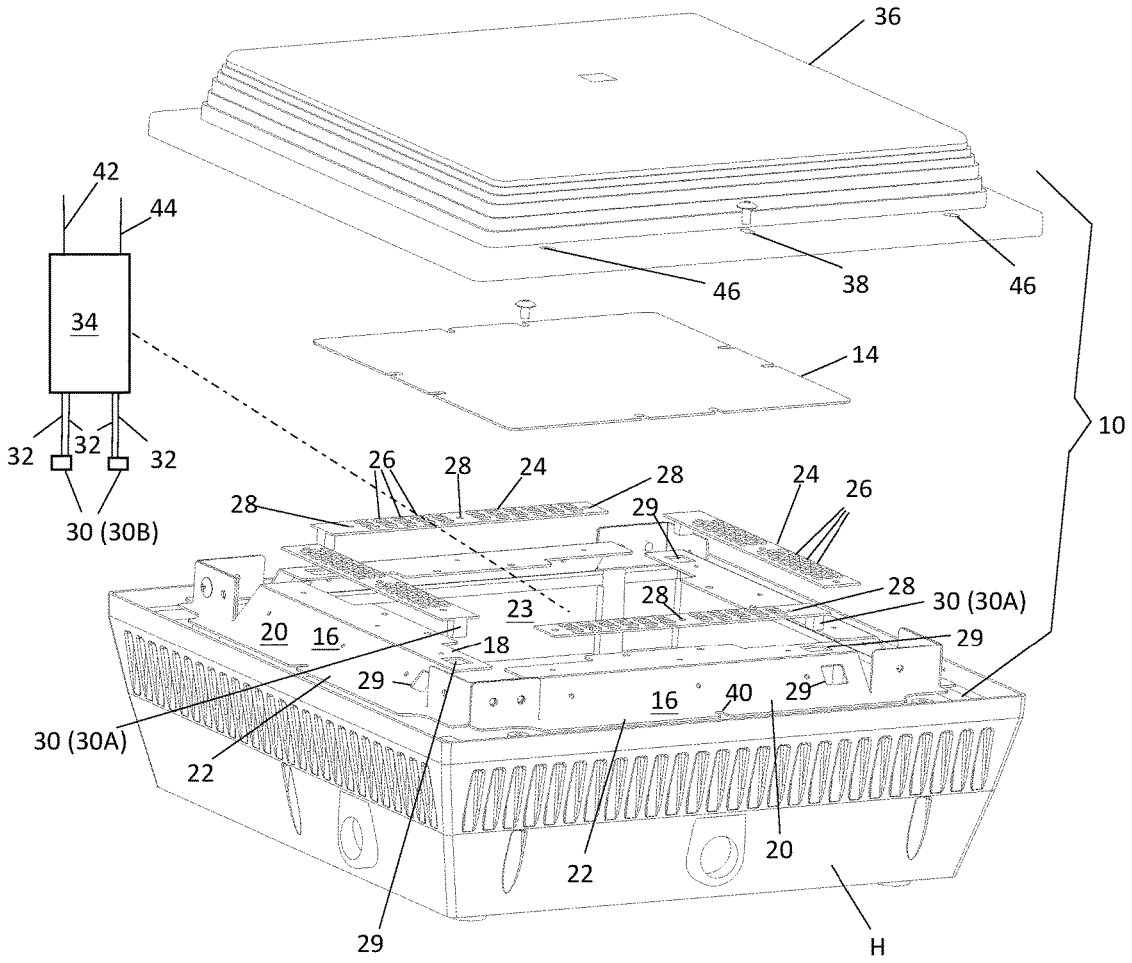
FIGS. 1-6 show different features of the subject invention.
Figure 2:
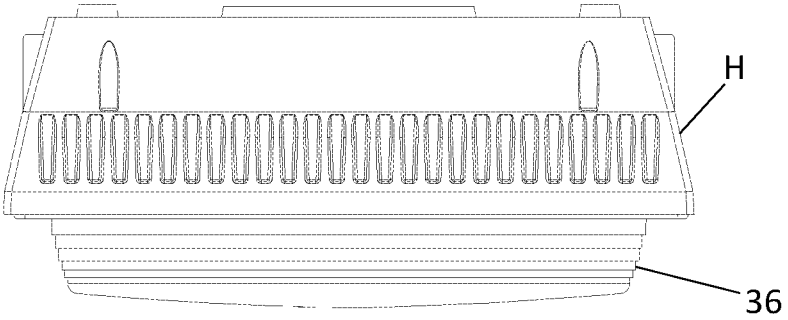
Figure 3:
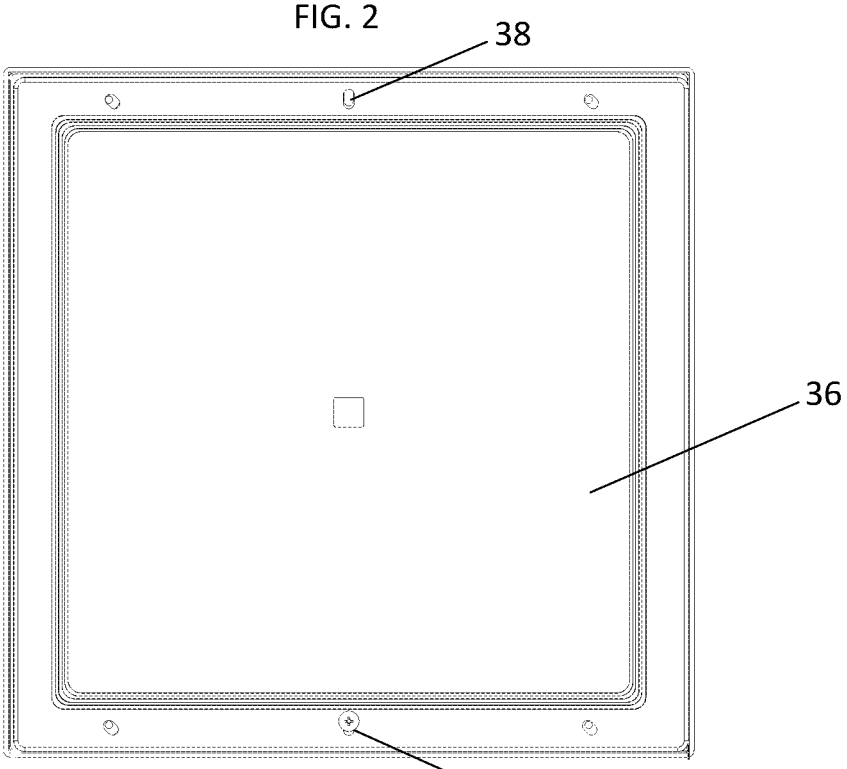
Figure 4:
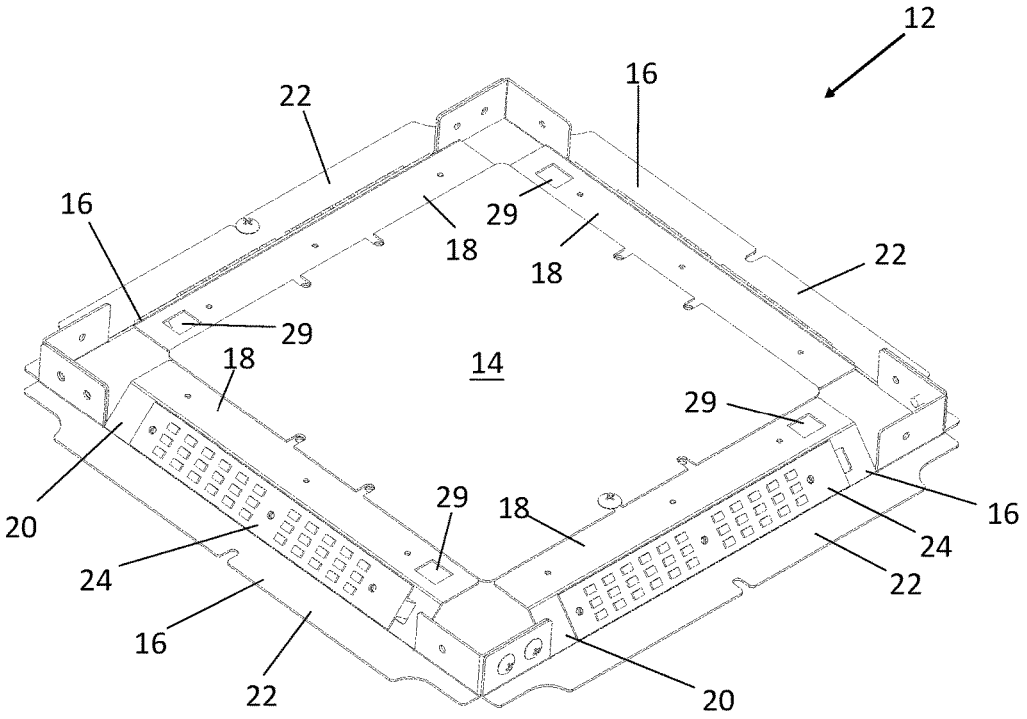
Figure 5:
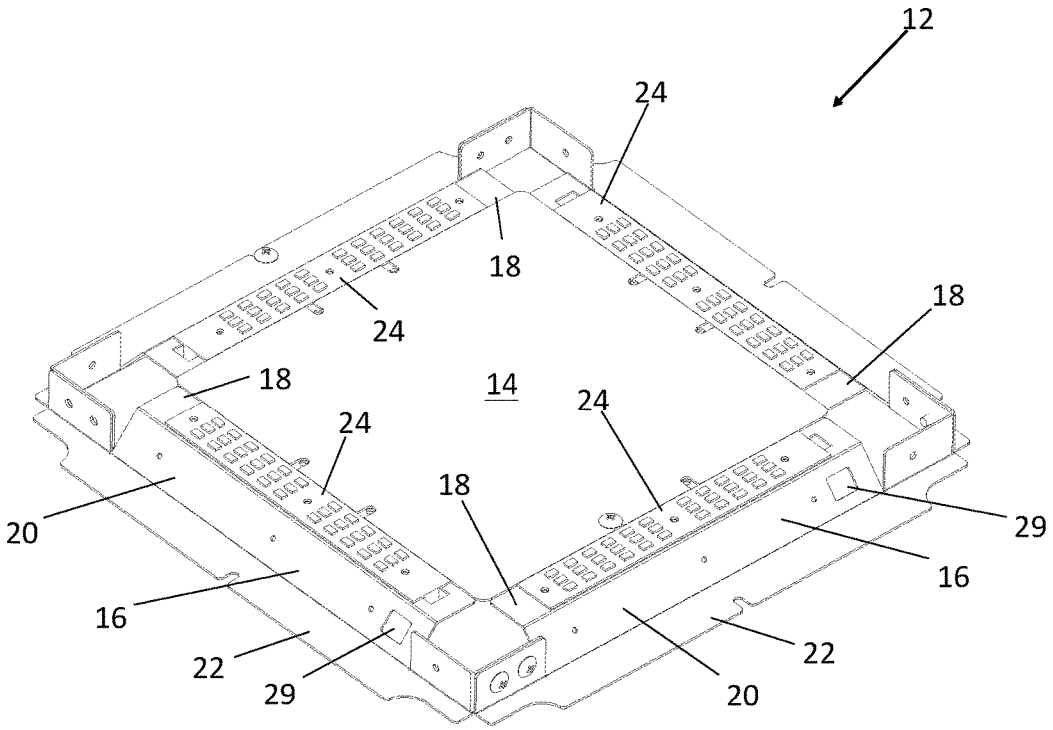
Figure 6:
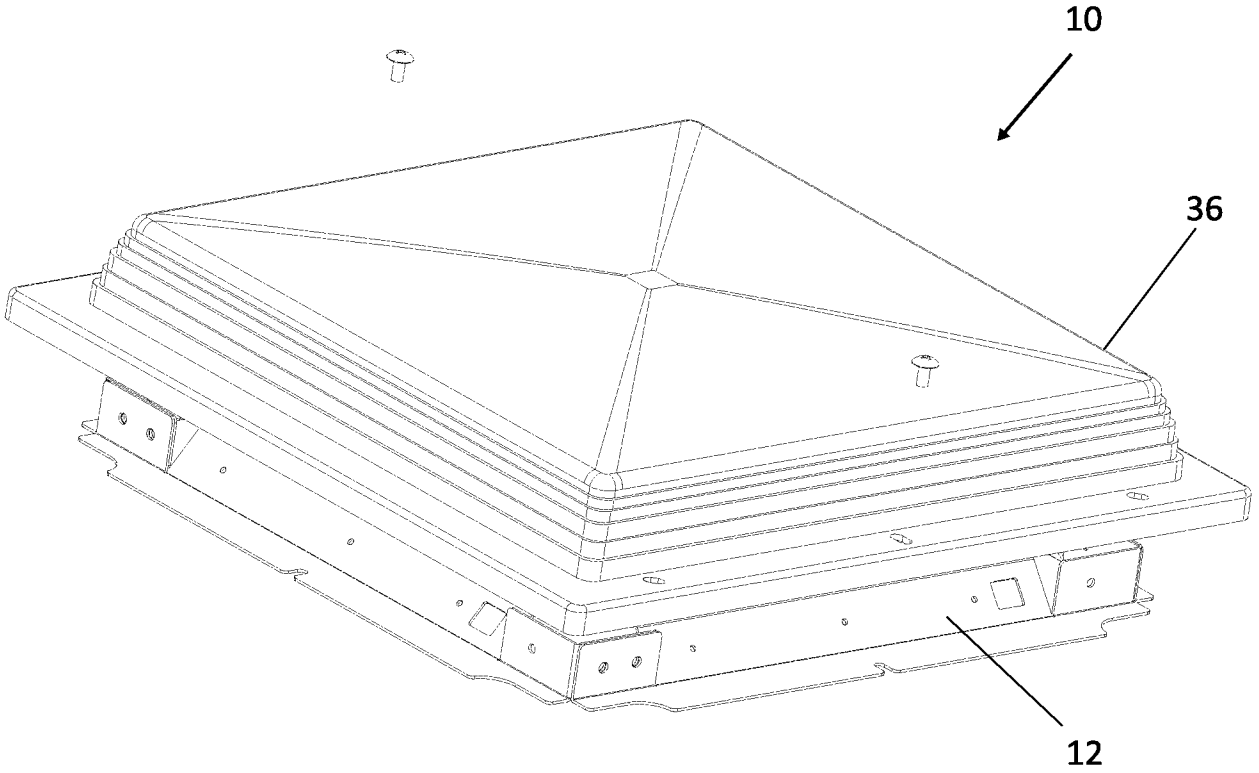

With reference to the Figures, an assembly is shown for retrofitting a HID canopy light fixture. The assembly is generally designated with the reference numeral 10. The assembly 10 generally includes a frame 12 having an inner panel 14 and a plurality of edge members 16 perimetrically bounding the inner panel 14. The inner panel 14 and the edge members 16 are preferably formed from metal, such as stamped steel or aluminum. It is preferred that the inner panel 14 and the edge members 16 be separately formed and assembled thereafter. The edge members 16 may be secured to the inner panel 14 in any known manner, including screw mounting, rivet mounting, adhesive, and/or fusion (including welding). The inner panel 14 and the edge members 16 may be unitarily formed, e.g., stamp formed from a single blank.

Each of the edge members 16 is formed with a first edge panel 18 secured to the inner panel 12, a downwardly angled second edge panel 20 depending from the first edge panel 18, and a flange 22 extending from the second edge panel 20. Each of the first edge panels 18 and the second edge panels 20 is sized to support thereon at least one board containing a plurality of solid state light generating elements.

As shown in FIG. 1, the inner panel 14 and the edge members 16 collectively define a contained volume 23 sized to accommodate at least one driver for electrically powering solid state light generating elements. The depth of the contained volume 23 is generally defined by the vertical extent of the second edge panels 20.

Preferably, the flanges 22 of the edge members 16 of the assembly 10 collectively define a footprint generally corresponding to the profile of the inner opening of a standard HID canopy light fixture housing, particularly at the location intended for lens mounting. This allows for the assembly 10 to be mounted to the interior of the housing in a retrofit procedure, as described below.

The assembly 10 is intended for use with solid state light generating elements, such as light emitting diodes (LED's), organic light emitting diodes (OLED's), and polymer light emitting diodes (PLED's). Solid state lighting is more energy efficient than HID lighting and the retrofitting of a HID light fixture with the assembly 10 results in energy savings with comparable light generation.

The solid state lighting is preferably provided in units of boards 24 with solid state light generating elements 26 being mounted thereto. The boards 24 may be circuit boards of any known type, including printed circuit boards (PCB's). The solid state light generating elements 26 are mounted to the boards 24 in any known manner so as to be ready for activation by application of electrical power to inputs on the respective boards 24. Any related wiring may be contained within the boards 24 as is known in the art.

With the provision of the first edge panels 18 and the second edge panels 20, different configurations for mounting the boards 24 are provided. For example, as shown in FIGS.

4 and 5, mounting the boards 24 to the first edge panels 18 results in a downward directed light throw, while mounting the boards 24 to the second edge panels 20 results in an outwardly angled light throw. Thus, the assembly 10 may be prepared for a specific application based on tailored light throw, with the desired light pattern being achieved with minimum energy usage. The downward light throw (with mounting to the first edge panels 18) may be desired where directed light is desired, such as in a gas station. The outwardly angled light throw (with mounting to the second edge panels 20) may be desired for larger area applications, such as entryway or parking construction applications. It is also possible to mount the boards 24 to both one or more of the first edge panels 18 and/or the second edge panels 20 to customize light patterns below and about a fixture, including providing a maximum lighting pattern with all of the first edge panels 18 and the second edge panels 20 having boards 24 mounted thereto.

The boards 24 may be secured to the first edge panels 18 and the second edge panels 20 using any known technique, including screw mounting. The first edge panels 18 and the second edge panels 20 may be pre-drilled with mounting holes 28 for screw mounting of the boards 24. Screw mounting allows for in-warehouse or on-site ready installation of the boards 24 based on specific ordering to allow for customizing light throw as discussed above.

Each of the first edge panels 18 and the second edge panels 20 also includes at least one wiring hole 29 preferably sized to accommodate a wiring connector 30 for electrical connection between a corresponding board 24 and a driver. To further ease preparation of the assembly 10, it is preferred that the boards 24 be each wired to have a connector portion 30A for cooperative mating with a connector portion 30B of an electrical supply wire 32. The connector 30 allows for plug-type connecting between the boards 24 and the electrical supply wires 32 in avoiding the need to connect individual supply and return lines. The connector 30 may be of any known cooperating structure (e.g., two-part).

At least one driver 34 is secured to the inner panel 14, preferably within the contained volume 23. Each of the drivers 34 is configured to receive electrical power in alternating-current form and transform such to a direct-current form, at the required power level. The electrical supply wires 32 are electrically connected to the output(s) of the driver(s) 34 to receive and convey electrical power to the boards 24.

It is preferred that the assembly 10 include, in an assembled state, the frame 12, the boards 24, the electrical supply wires 32 and the at least one driver 34, prior to retrofitting a targeted HID canopy light fixture. In this manner, the assembly 10 is a one-piece unit having a light pattern configured to the target location with all internal wiring being completed. This eases the retrofitting process. Optionally, a lens 36 may be also included with the assembly 10 in the assembled state. The lens 36 is light transmissive and preferably formed of a polymeric material, such as an acrylic. The lens 36 may include mounting holes 38 aligned with mounting holes 40 in the flanges 22. The lens 36 may be screw mounted to the flanges 22. To further facilitate the retrofit process, preferably, an electrical supply line 42 and an electrical return line 44 are provided for each of the driver(s) 34 ready for electrically connecting to an electrical power supply and receiving input alternating-current electrical power. A ground wire may be also provided.

The lens 36 may be generally tray-shaped to provide the assembly 10 with a relatively low profile. This is advantageous in that an overall slimmer design, as compared to the HID canopy light fixture prior to retrofitting, is provided. The lens for a HID canopy light fixture is typically dome-shaped to have head space for heat dissipation. The heat dissipation of the assembly 10, due to the use of solid state lighting, is of lesser concern than with HID lighting.

To retrofit a HID canopy light fixture, the lens of the fixture is initially removed. Once removed, an internal reflector is removed to which is secured the socket or other mounting structure for the HID lamp. The removal of the internal reflector exposes the interior of the housing. Thereafter, the power supply cables to the ballast of the fixture are disconnected and then connected to the electrical supply line 42 and the electrical return line 44 of each of the driver(s) 34, in parallel if necessary. Thereafter, the assembly 10 is secured to the housing H of the fixture using the same mounting holes used for the mounting of the original lens (the original lens being replaced with the lens 36). Mounting holes 46 may be provided in the lens 36 positioned to be in alignment with the mounting holes in the housing. With screw mounting the lens 36 to the housing H, the assembly 10 is secured to the HID canopy light fixture ready to generate solid state lighting.

As will be appreciated by those skilled in the art, additional elements may be provided with the assembly such as motion or photovoltaic sensors, to control the lighting subject to movement and ambient light levels. One or more of such sensors may be secured to the inner panel 14 so as to protrude through the lens 36. With being located on the inner panel 14, the sensor(s) may be located interiorly of the boards 24, resulting in a minimization of signal confusion resulting from light generated by the boards 24.

The subject invention allows for multiple configurations of the assembly 10 to be formed from a limited inventory of parts. In inventory, a plurality of inner panels 14, edge members 16 and boards 24 may be provided. The boards 24 may be each provided with the connector portion 30A. In addition, the inventory may include the drivers 34 rated at a predetermined number of power output (wattage) levels, such as three different wattage levels. The availability of different power output power levels for the drivers 34 provides for additional variability in the assembly 10 by allowing for different light intensities. Furthermore, the inventory may contain a plurality of the electrical supply wires 32 and the lenses 36. The electrical supply wires 32 may be each provided with the connector portion 30B to facilitate assembling of the assembly 10. Further, all mountings may be screw mountings with a single screw type. In this manner, the inventory may contain one supply of screws.

The assembly 10 may be formed from the inventory as described above. In addition to the boards 24 being mounted to one or more of the first edge panels 18 and the second edge panels 20, thus providing variability in generated light patterns, light intensity may be also varied based on the driver 24 power output selection.

The invention claimed is:

1. A solid state HID canopy light fixture retrofit assembly comprising:

an inner panel; and, a plurality of edge members perimetrically bounding the inner panel, each of the edge members having:

a first edge panel secured to the inner panel;

a downwardly angled second edge panel depending from the first panel; and, a flange extending from the second edge panel, wherein, the first and second edge panels are each sized to support thereon at least one board containing a plurality of solid state light generating elements, wherein, the inner panel and the edge members collectively define a contained volume sized to accommodate at least one driver for electrically powering the solid state light generating elements.

2. An assembly as in claim 1, wherein the flanges of the edge members collectively define a footprint generally corresponding to the profile of the inner opening of a standard HID canopy light fixture housing.

3. An assembly as in claim 1, wherein the flanges each includes at least one mounting hole.

4. An assembly as in claim 1, wherein at least one wiring hole is provided in each of the first and second edge panels of the edge members, each of the wiring holes being sized to accommodate a wiring connector to allow for electrical connection between a corresponding board and a driver.

5. A solid state HID canopy light retrofit assembly comprising:

an inner panel;

a plurality of edge members perimetrically bounding the inner panel, each of the edge members having:

a first edge panel secured to the inner panel;

a downwardly angled second edge panel depending from the first panel; and, a flange extending from the second edge panel, wherein, at least one wiring hole is provided in each of the first and second edge panels;

a plurality of boards each containing a plurality of solid state light generating elements, the boards being mounted to one or more of the first edge panels and the second edge panels;

at least one driver secured to the inner panel, the at least one driver configured to receive alternating current electrical power and to transmit direct current electrical power for electrically powering the solid state light generating elements; and, a plurality of electrical supply wires for electrically conveying the direct current electrical power from the at least one driver to the boards via the corresponding wire holes.

6. An assembly as in claim 5, wherein the inner panel and the edge members collectively define a contained volume sized to accommodate the at least one driver.

7. An assembly as in claim 5, wherein an electrical supply line and an electrical return line are provided with the at least one driver prepared for receiving the alternating current electrical power.

8. An assembly as in claim 5, further comprising a lens secured to the flanges such that the solid state light generating elements generally face the lens to transmit generated light therethrough.

9. An assembly as in claim 8, wherein the lens includes at least one mounting hole for securing to a housing of a HID canopy light fixture.

10. An assembly as in claim 5, wherein the flanges of the edge members collectively define a footprint generally corresponding to the profile of the inner opening of a standard HID canopy light fixture housing.

* * * * *